US005226543A

United States Patent [19]

Foos et al.

[11] Patent Number: 5,226,543

[45] Date of Patent: Jul. 13, 1993

[54] PACKAGING FOR FRAGILE ARTICLES

[75] Inventors: Douglas E. Foos, Barrington Hills, Ill.; Thomas Stephens, Los Gatos, Calif.

[73] Assignees: Plastofilm Industries, Inc., Wheaton, Ill.; Roberts, Stephens, Van Amburg Packaging Inc., Soquel, Calif.

[21] Appl. No.: 840,453

[22] Filed: Feb. 24, 1992

[51] Int. Cl.[5] ..... B65D 81/02

[52] U.S. Cl. ..... 206/592; 206/320; 206/490; 206/521; 206/591; 206/564

[58] Field of Search ..... 206/320, 326, 472, 477, 206/485, 486, 490, 521, 521.2, 521.6, 521.7, 586, 588, 591, 592, 564, 561

[56] References Cited

U.S. PATENT DOCUMENTS

| | | | |
|---|---|---|---|
| 2,783,930 | 3/1957 | Riley | 206/320 |
| 2,935,206 | 5/1960 | Smith | 206/564 |
| 2,974,788 | 3/1961 | Robbins | 206/485 |
| 2,994,466 | 8/1961 | Thompson . | |
| 3,176,743 | 4/1965 | Bundy . | |
| 3,181,766 | 5/1965 | Kane et al. . | |
| 3,366,231 | 1/1968 | Trakas | 206/320 |
| 3,437,423 | 4/1969 | Mondiadis | 206/561 |
| 3,724,654 | 4/1973 | Gerard et al. | 206/564 |
| 3,768,639 | 10/1973 | Dogliotti | 206/564 |
| 3,835,986 | 9/1974 | Le Beau | 206/320 |
| 4,006,818 | 2/1977 | Wannyn | 206/486 |
| 4,132,311 | 1/1979 | Glinert | 206/564 |
| 4,398,212 | 8/1983 | Serry et al. | 206/320 |
| 4,645,079 | 2/1987 | Hill | 206/564 |
| 4,671,407 | 6/1987 | Brutosky | 206/564 |
| 4,709,808 | 12/1987 | Balduff et al. . | |
| 4,823,956 | 4/1989 | Belisle | 206/591 |
| 4,883,179 | 11/1989 | Dionne . | |
| 4,972,951 | 11/1990 | Vartanian | 206/387 |

FOREIGN PATENT DOCUMENTS

| | | | |
|---|---|---|---|
| 3843990 | 7/1990 | Fed. Rep. of Germany . | |
| 1224493 | 3/1971 | United Kingdom | 206/586 |
| 2229416 | 9/1990 | United Kingdom | 206/320 |

*Primary Examiner*—David T. Fidei
*Attorney, Agent, or Firm*—Welsh & Katz

[57] ABSTRACT

The invention provides a unitary packaging structure for a shock sensitive article. The packaging structure includes a platform portion which includes a platform portion adapted to support the article, and a sidewall structure of preferably flexible material forming an enclosure around the platform portion. The sidewall structure includes an inboard wall being integral with the platform portion, and an outboard wall maintained in spaced relationship from the inboard wall by a bridge section, the inboard wall being relatively shorter than the outboard wall so that the platform portion is held a specified cushion distance above a lower edge of the outboard wall. Shock limiting formations are formed in the sidewall structure for restricting the movement of the platform portion toward the lower edge of the outboard wall upon shock loading of the platform portion.

22 Claims, 5 Drawing Sheets

PACKAGING FOR FRAGILE ARTICLES

DESCRIPTION

1. Technical Field

The present invention relates to packaging for fragile structures such as computer monitors, microwave ovens, television sets or the like. More particularly, the invention relates to a flexible, thermally formed type of plastic packaging, of unitary construction, which is adapted to hold such fragile articles and to dissipate forces exerted upon boxes containing such articles in such a manner that the articles are not damaged if the box is dropped or mishandled.

2. Background of the Invention

Currently, the shipment of fragile articles, regardless of size and weight, requires special packaging to avoid damage to the articles. For this purpose, materials such as crumpled paper, nuggets of expanded foam, and/or preformed expanded polystyrene foam is used to package fragile articles, including but not limited to electronic articles such as computer monitors, radios, television sets, computer CPUs, microwave ovens, disk drives, VCR's and the like. The preformed polystyrene foam material is often provided in the form of "corners" or other support pieces which envelop at least portions of the packaged fragile article.

Aside from being bulky, upon an initial impact, the polystyrene foam loses virtually all of its shock absorbing qualities. Thus, fragile articles packaged with rigid pieces of expanded polystyrene foam as the protective media are susceptible to damage from repeated shocks to the box or container. A related disadvantage of such foam packaging is that a relatively thick piece of foam must be employed to protect a packaged article from impact, even though only a portion of the foam will be compressed upon impact.

Another disadvantage of conventional polystyrene foam is that its bulkiness requires packagers to allot significant warehouse storage space to the foam packaging elements prior to use. Also, shippers are required to select shipping containers, such as corrugated boxes, which are substantially larger than the article being packaged, merely to accommodate sufficient thicknesses of polystyrene foam which can absorb only one impact. Larger containers require additional warehouse space, both before and after assembly, and also take up more space per article shipped in rail cars or trailers.

Yet another disadvantage of conventional packaging for fragile articles is that because of its bulkiness, it is not generally economically feasible to ship the expanded polystyrene foam to a recycling location. Furthermore, even when the expanded polystyrene foam is recycled into product, the cost of recycling is relatively large and, generally, no more than about 25% recycled content can be utilized, with the remainder being virgin material. Indeed, considering the great quantity of expanded polystyrene foam which is currently in use to provide fragility packaging and the general lack of adequate recycling of this material, the adverse environmental impact is of staggering proportions. The present invention is directed to overcoming one or more of the above-identified problems.

DISCLOSURE OF INVENTION

In accordance with an embodiment of the present invention, a unitary packaging structure is provided for a shock sensitive article, and includes a platform portion adapted to support the article and having a peripheral portion, and a sidewall structure forming an enclosure around the platform portion, the sidewall structure including an inboard wall being integral with the peripheral portion, and an outboard wall maintained in spaced relationship from the inboard wall by a bridge section, the inboard wall being relatively shorter than the outboard wall so that when the package is set upon a horizontal surface, the platform portion is held a specified distance above a lower edge of the outboard wall. At least one such unitary package is preferably used for protecting fragile articles.

In accordance with another embodiment of the present invention, a unitary packaging structure is provided for a shock sensitive article, and includes a platform portion adapted to support the article, the platform portion having a peripheral portion. A sidewall structure forms an enclosure about the peripheral portion. The sidewall structure has a bridge section which has inboard and outboard edge portions. A relatively shorter wall has a proximal end integral with the inboard edge portion of the bridge section and a distal end extending in a direction away from the bridge section. A relatively longer wall has a proximal end integral with the outboard edge portion of the bridge section and a distal end extending in the direction away from the bridge section. The peripheral portion of the platform portion is integral with the distal end portion of the shorter wall such that the platform portion is supported by the sidewall structure.

The packaging structure is formed of a flexible material so as to provide shock absorption. Indeed, a significant advantage of the present package over conventional polystyrene foam packaging is that the present package can absorb repeated impact shocks without losing its resilience or shock absorptive capability.

Another advantage of the present package is that it is able to withstand repeated compressive shocks of sufficient force to cause the tray to virtually "bottom out" or reach the lower edge of the outboard wall, but is prevented from bottoming out by a stop device integrally formed into the sidewall structure.

Yet another advantage of the present packaging structure is that it can be readily formulated from a material which can be recycled. Also, the packaging structure can be made in such a manner that many such structures can be nested together, thus occupying minimum storage space. The present packages can be readily stacked together prior to use, and once used, can be collected and returned to the manufacturer/packager in nested form for reuse. Yet, all of this is accomplished with a structure which provides very adequate dissipation of forces which are exerted upon boxes, for example cardboard cartons or the like, in which fragile articles packed in the packaging structures are positioned without harm to the articles. Furthermore, the articles can be made by a very inexpensive and efficient manufacturing procedure, namely by thermoforming them.

BRIEF DESCRIPTION OF THE DRAWINGS

The present invention will be better understood by reference to the figures of the drawings wherein like numbers denote like parts throughout and wherein.

BEST MODE FOR CARRYING OUT INVENTION

Figure 1:
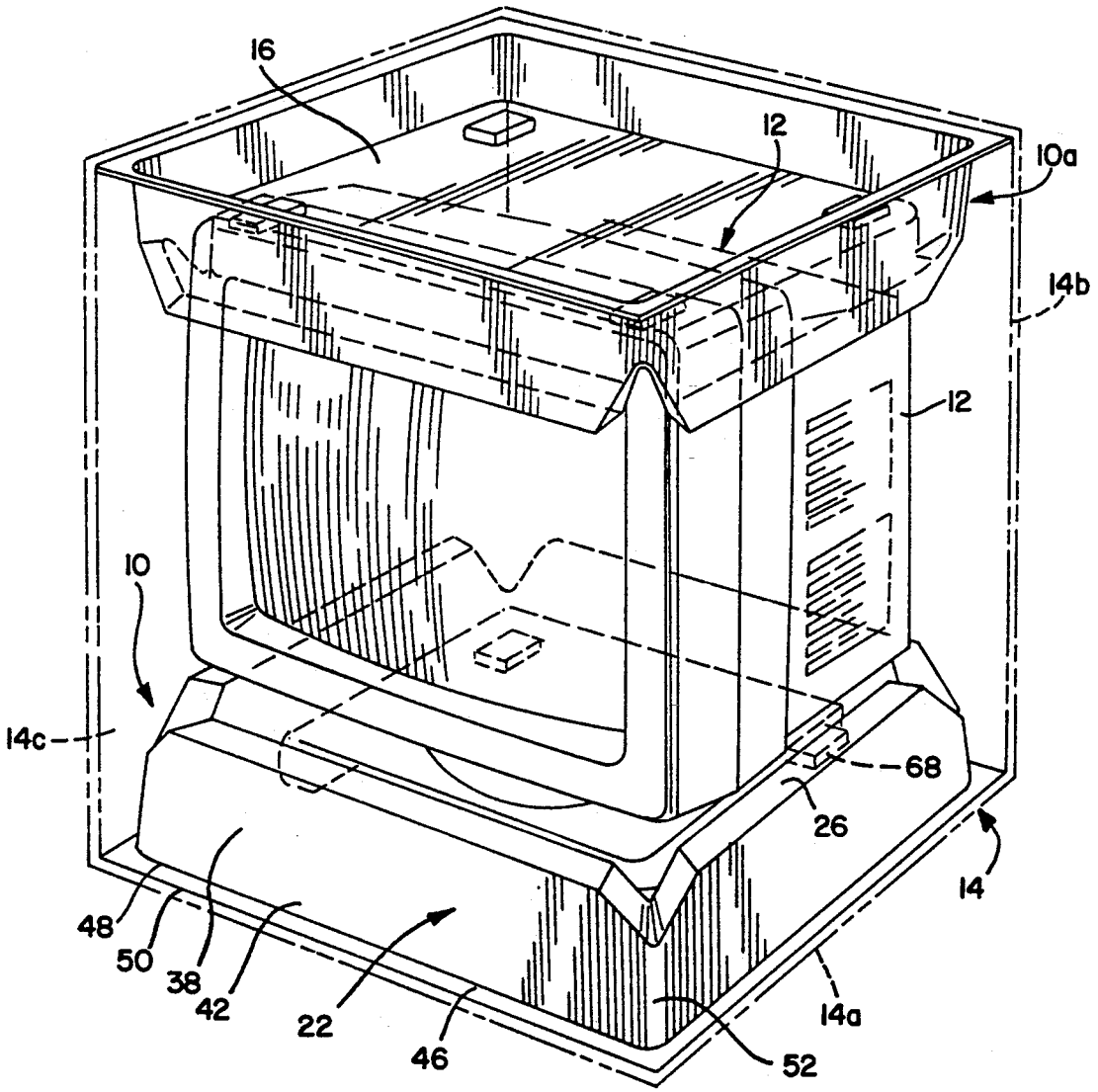
FIG. 1 illustrates, in a top perspective view, a computer monitor located in an enclosure in a form of packaging in accordance with an embodiment of the invention, and also having a package of the invention positioned on a top surface of the monitor.

The preferred embodiment of the present invention provides a unitary packaging structure 10 as shown in FIGS. 1, 2 and 4–8. An alternate embodiment is shown in FIG. 3 and is generally designated 110. Components and features which are shared by the structures 10 and 110 have been designated with identical reference numerals. As illustrated in FIG. 1, the unitary packaging structure 10, 110 is adapted to hold a shock sensitive article 12 such as the computer monitor shown in the figure. The packaging structure 10, 110, along with the article 12, will normally be positioned within a container 14, such as a box or corrugated carton. The bottom 14*a* and two walls 14*b*, 14*c* of the container 14 are shown in phantom in FIG. 1, in a relatively tight fitting arrangement about the article 12 and the packaging structure 10. Furthermore, another one of the unitary packaging structures 10, 110 is shown at 10*a* placed atop the sensitive article 12 to sandwich the article between two such packaging structures 10, 110 within the container 14.

Figure 2:
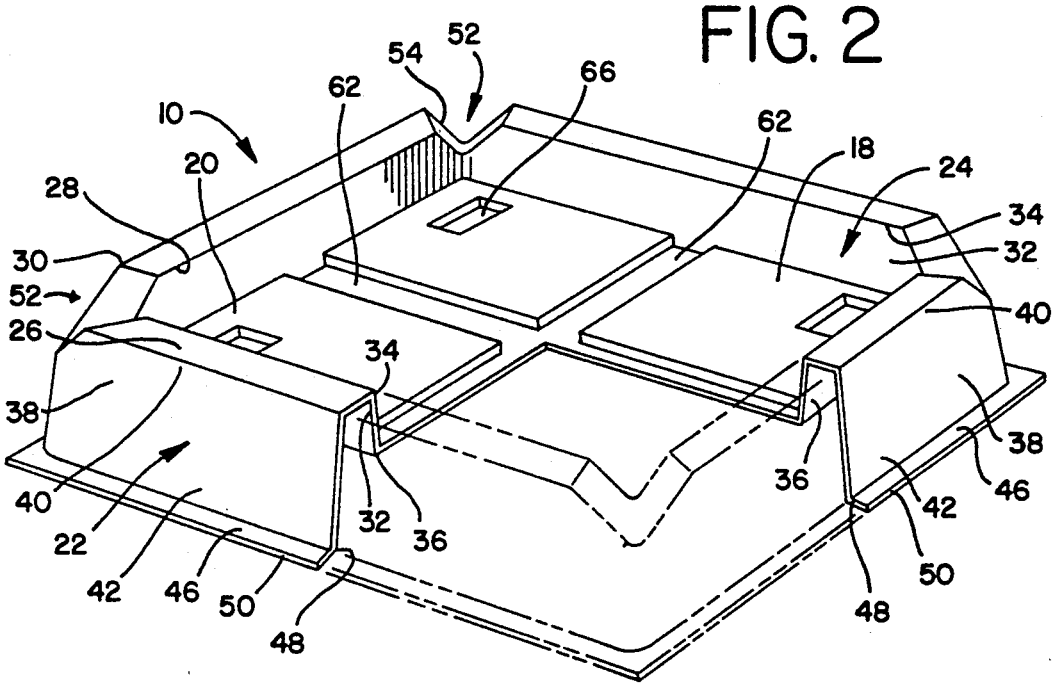
FIG. 2 illustrates, in a perspective view of the present packaging structure taken similar to the view of FIG. 1 with portions shown cut away.
Figure 3:
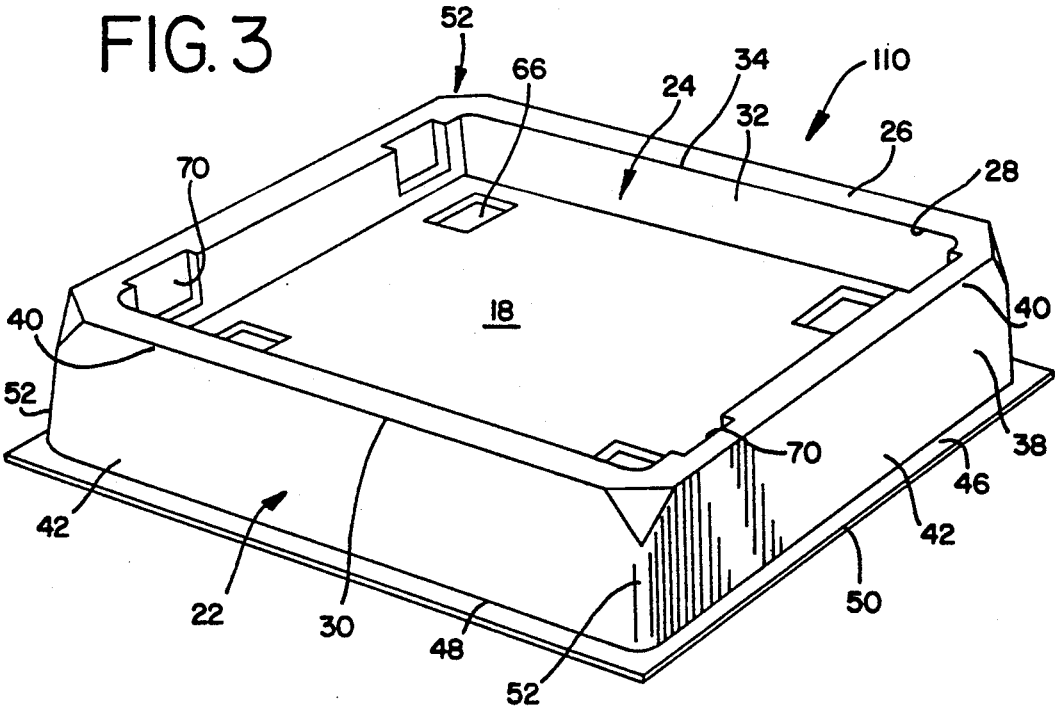
FIG. 3 illustrates, in a view similar to FIG. 2 but without any portion cut away, an alternate embodiment in accordance with the present invention.
Figure 4:
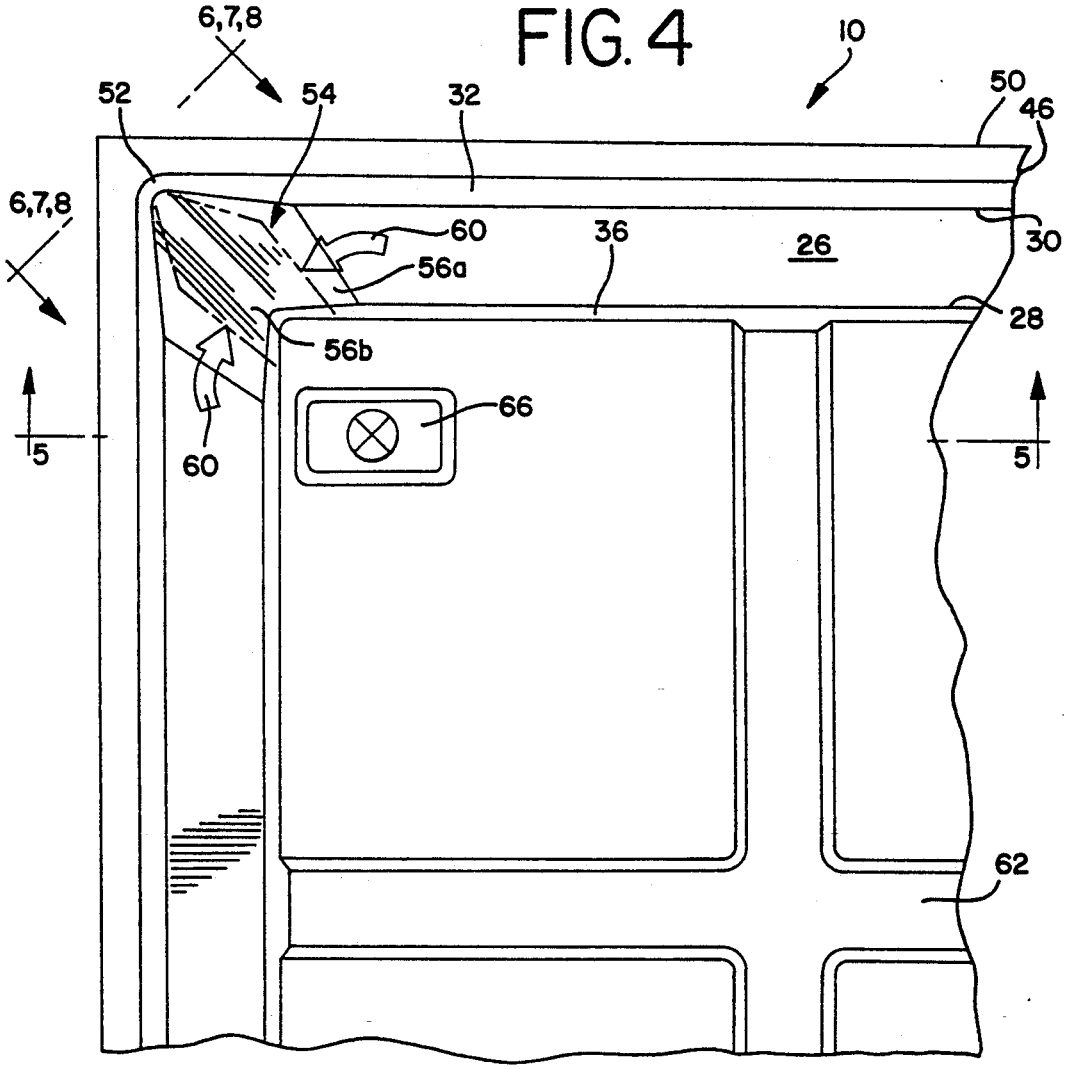
FIG. 4 illustrates, in partial plan view, a quadrant of the embodiment illustrated in FIG. 2.
Figure 5:
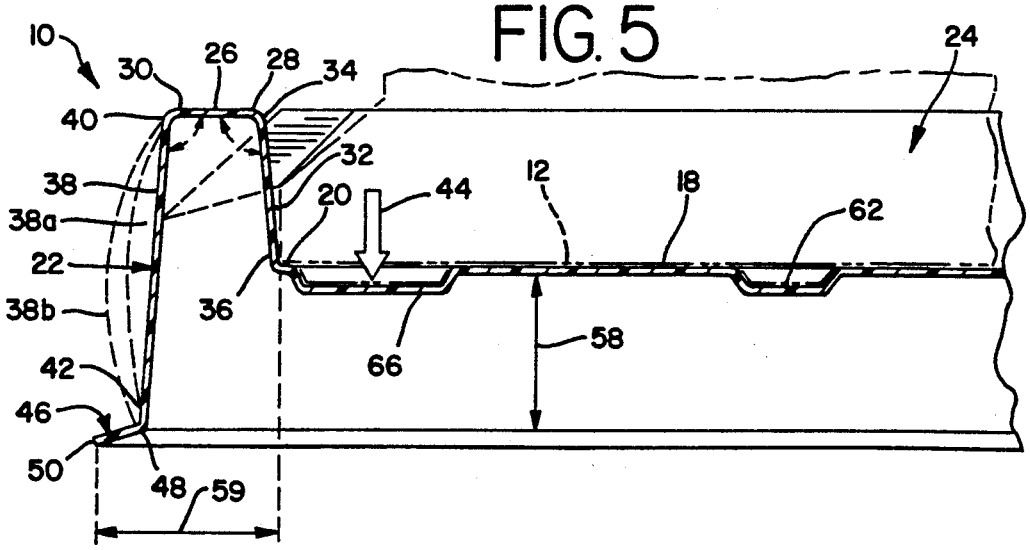
FIG. 5 illustrates a view taken along the line 5—5 of FIG. 4 and in the direction indicated generally.
Figure 11A:
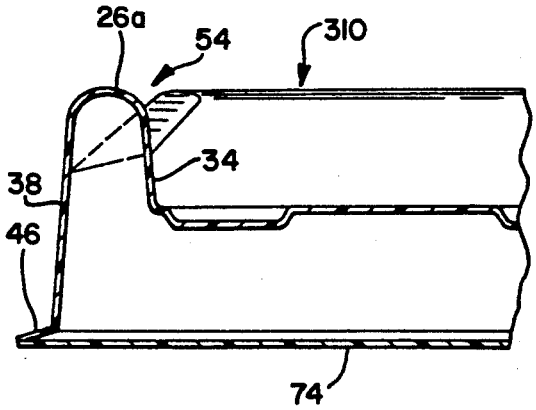
FIG. 11*a* is a partial vertical sectional view of another alternate embodiment of the invention.
Figure 11B:
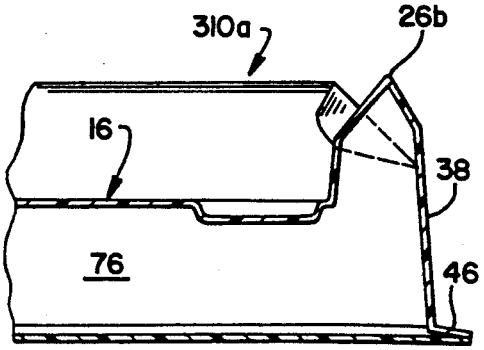
FIG. 11*b* is a partial vertical sectional view of an alternate embodiment of the structure depicted in FIG. 11*a*.

Referring to FIGS. 1, 2 and 5, it will be seen that the unitary packaging structure 10 is in the general form of a tray having a platform portion 18 which is adapted to support the shock sensitive article 12. The platform portion 18 has a peripheral portion 20 which is attached to a sidewall structure 22 forming part of the tray. The sidewall structure 22 forms an enclosure 24 which, in the preferred embodiment, when viewed from above or below, is in the shape of a polygon, such as the rectangle shape shown in FIG. 4, or of an arcuate structure such as a circle, oval or ellipse. The sidewall structure 22, as may be seen most clearly in FIG. 5, has a transverse bridge section 26 which has an inboard edge portion 28 and an outboard edge portion 30. The bridge section 26 may be a generally flat, horizontal member, as shown in FIGS. 1–8, but may also be provided in other shapes, such as the curved cross-section, as shown in FIG. 11*a* or the pointed cross-section, as shown in FIG. 11*b*.

A relatively shorter, inboard wall 32 has a proximal end 34 which is integral with the inboard end portion 28 of the bridge section 26 and has a distal end 36 which extends in a direction away from the bridge section 26. The sidewall structure 22 also has a relatively longer wall 38 with a proximal end 40 which is integral with the outboard end portion 30 of the bridge section 26. The relatively longer outboard wall 38 has a distal or lower end 42 which extends in a direction away from the bridge section 26.

The peripheral portion 20 of the platform portion 18 is integral with the distal end portion 36 of the shorter wall 32 such that the platform portion 18 of the platform portion 18 is supported by the sidewall structure 22. In other words, the platform portion 18 is held in suspended relationship above a lower end 42 of the longer wall 38 by the sidewall structure 22. The distance between the platform portion 18 and the lower edge of the lower end 42 will be referred to as the cushion thickness 58 (best seen in FIG. 5).

Referring once again to FIG. 5, it will be noted that the base of the shock sensitive article 12 is in a relatively tight fit against the shorter wall 32 of the sidewall structure 22. Indeed, for better shock protection it is preferred that the shorter wall 32 is adapted to pressingly engage the article 12 when the article 12 is positioned on the platform portion 18 (best seen in FIG. 7).

The sidewall structure 22 can include a foot structure 46 which has an inner peripheral edge 48 and an outer peripheral edge 50. The foot structure 46 extends along the lower end 42 of the longer wall section 38. The outer edge 50 of the foot structure 46 extends outboard from the lower end 42 of the longer wall 38. Generally, the foot structure 46 will be made integrally with the lower end 42 of the longer wall 38. It is preferable that the foot structure 46 flare outwardly from the lower end 42 of the longer wall 38 at such an angle that when the foot structure 46 is positioned against a flat surface, for example, against the bottom 14*a* of the container 14, the outer edge 50 of the foot structure 46, which is in contact with the container walls 14*b*, 14*c*, will make an acute angle with the flat surface. This allows additional flexure at the joinder of the lower end 42 of the longer wall 38 with the foot structure 46, whereby forces exerted in the direction shown by the arrow 44 (best seen in FIG. 5) can be more adequately dissipated without harm to the shock sensitive article 12.

At least one corner 52 is provided to the sidewall structure 22 when the structure is of polygonal shape as shown in the preferred embodiment in FIG. 2, each corner defining a pair of wall segments from adjacent portions of the sidewall structure. Thus, in a quadrilateral packaging structure 10, 110, the four corners 52 will define four wall segments, each segment including a portion of the shorter wall 32, a portion of the longer wall 38, and a portion of the bridge section 26.

To allow shocks to be dissipated through the packaging structure 10, 110, the structure is formed of a flexible, preferably polymeric, material to allow shocks to be dissipated primarily via flexing of the walls 32 and 38 which, after such flexing, elastically return to their original shape. An advantage of this property is that the present packaging structure 10, 110 may absorb repeated shock impacts without deteriorating. Any of a number of polymeric materials can be utilized to form the unitary packaging structure 10, 110. Generally, such materials will be characterized by the physical properties of durability, elasticity or "memory", high and low temperature stability, and thermoformability.

Particularly useful for forming the unitary packaging structure 10, 110 of the present invention is high density polyethylene (HDPE), although other polymeric materials may be equally suitable, depending on the application. High density polyethylene generally has a stiffness of about 150,000 psi. This provides sufficient flexibility for the purposes of the present invention and sufficient elasticity so that the packaging structure 10, 110 will return to its original loaded or less stressed state following absorption of a shock. If desired, the HDPE used in making the packaging structure 10 may be recycled, post-consumer material.

The sheets of polymeric material which are thermoformed into the packaging structure 10, 110 will generally be from about 10 to about 90 gauge (mils) in thickness. In addition to thermoforming, it is contemplated that the present packaging structure 10, 110 may also be produced by injection molding. Regardless of the method of manufacture, the particular thickness of the polymeric material making up the sidewall structure 22 and the platform portion 18 will be a function of the specific properties of the polymeric material itself, and the weight and shape of the shock sensitive article 12 which is to be supported by the particular packaging structure 10, 110. Generally, the packaging structure 10, 110 of the present invention can be designed to provide sufficient protection for the packaged article 12 to provide protection as low as the 20 g level under all ambient weather conditions.

Referring now to FIGS. 1, 4 and 5, if an article 12 is positioned upon a unitary packaging structure 10, another such structure 10*a* is placed atop the article 10, and the combination of the packaging structure and shock sensitive article is placed in the container 14, a typical shipping arrangement will result. If this arrangement is shocked, as by dropping it, there will be a resultant force downwardly upon the platform portion 18 of the platform portion 18 as shown by the arrow 44 in FIG. 5, and by the dashed arrow 44 shown in FIG. 7.

In response to the force represented by the arrow 44, the platform portion 18 will be drawn downwardly in FIG. 5, thus exerting a downward force upon the shorter wall 32 as well as the bridge 26. This action will exert a flexing, downwardly directed force upon the longer wall 22 which will cause it to bow out to some extent, usually to the point where the bowed longer wall will contact an inside surface of the container 14. This bowing action is shown in phantom in lines 38*a* and 38*b*, and will be described in greater detail in relation to FIGS. 6–8.

Through this flexing action, the downward force illustrated by the arrow 44 exerted upon the platform 18 is dissipated into a lateral force by the sidewall structure 22. More specifically, this force is taken up in flexure of the walls 32 and 38, and the bridge section 26. Ideally, the flexure of the sidewall structure 22 will permit the platform 18 to descend into the cushion distance 58 up to a maximum extent which is less than or equal to the lower end 42 of the longer wall 38. In the preferred embodiment, the platform 18 is designed to descend approximately 90% of the cushion distance under maximum shock load.

Repeated shock loading does not impair the ability of the present packaging structure 10 to repeatedly compress as much as 90% of the cushion distance 58. In contrast, conventional polystyrene foam packaging can withstand only a single impact causing a maximum of 60–70% compression into the cushioning distance of the foam. A significant feature of this property of the present package structure 10 is that the overall profile of the container 14 is significantly smaller in size than when the fragile article 12 is packaged using conventional polystyrene foam.

Referring now to FIGS. 3 and 5, it will be noted that when a force, as represented by the arrow 44, is exerted upon the platform 18, aside from the flexing of the inner and outer walls, 32, 38, and the bridge section 26, there is a peripheral compression of the sidewall structure 22 around the enclosure 24. This compression causes the inboard edge 28 to tightly engage the packaged article 12, and also causes exceptional stresses at at least one corner 52, where corresponding wall segments of the sidewall structure 22 meet. With a unitary packaging structure 110 having the particular configuration of the corner 52 as shown in FIG. 3, this compression force can become strong enough to crinkle and/or damage the structural integrity of the unitary packaging structure 110 at the corner 52.

In order to more readily dissipate forces of the nature represented by the arrow 44, it is preferable that certain geometry be provided to the packaging structure 10, 110. Accordingly, in accordance with a preferred embodiment of the present invention, the unitary packaging structure 10 is constructed as shown in FIGS. 1, 2 and 4–8.

Specifically, a shock limiting device 54 is provided for absorbing the vertical compression experienced by the platform 18 when a vertical shock force is suffered. The shock limiting device 54 is preferably configured as a V-shaped indentation which is formed in the sidewall structure 22, and is integral with the bridge 26, the shorter wall 32 and the longer wall 38. The indentation 54 extends from the bridge 26 into the shorter wall 32 and into the longer wall 38, and has end faces 56*a*, 56*b*.

As part of the corner 52, each indentation 54 defines the adjacent portions of the sidewall structure 22 into wall segments. The indentations 54 are configured and positioned on the sidewall structure 22 to compress upon the exertion of the generally vertically directed forces generated by shock impacts upon the container 14 which cause the platform portion 18 to move into the cushion distance 58. In the preferred embodiment, in order to provide protection against laterally directed shock impacts, the horizontal distance 59 between the peripheral edge of the platform portion 18 and the outer peripheral edge 50 of the foot 46 is approximately equal to the cushion distance 58. Thus, the sidewall structure 22 is configured to accommodate an amount of lateral compression which is approximately equal to said cushion distance.

Figure 6:
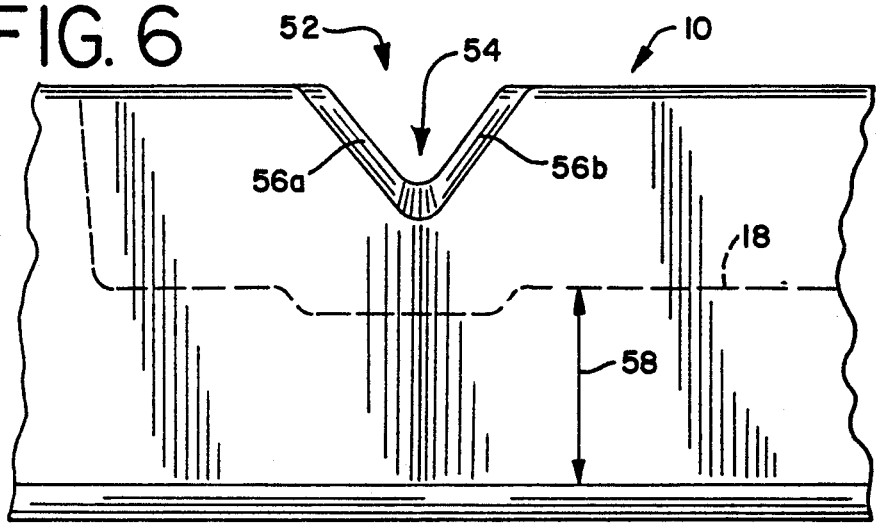
FIG. 6 illustrates a view taken along the line 6—6 of FIG. 4 and in the direction indicated generally when the packaging structure is in the unloaded position.

Referring now to FIG. 6, the packaging structure 10 of the invention is shown in the unloaded position, with the platform portion 18 at its uppermost location, and each of the indentations 54 at their most splayed position. This is the configuration of the packaging structure 10 prior to the placement of the fragile article 12 therein.

Figure 7:
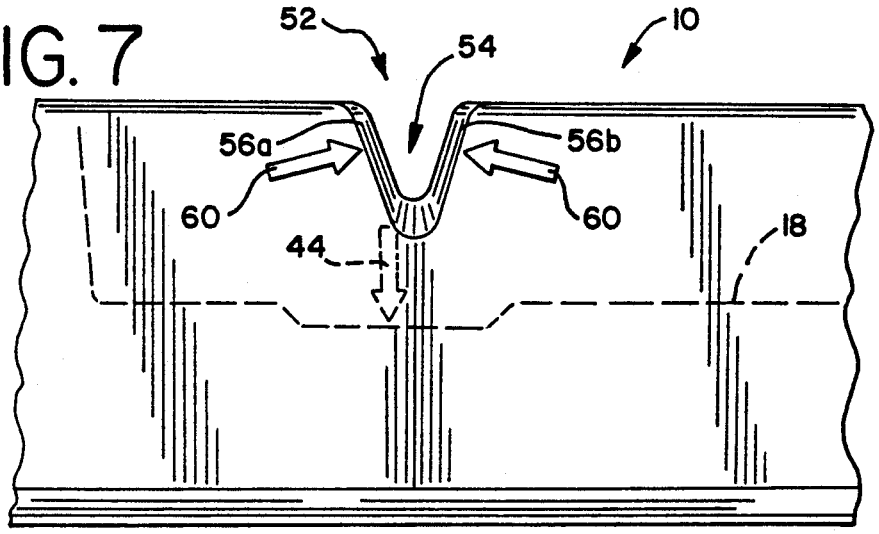
FIG. 7 illustrates a view taken along the line 7—7 of FIG. 4 and in the direction indicated generally with the corner of the embodiment of FIG. 4 being as shown by the dashed line in that figure when the packaging structure of the invention is loaded with a fragile article.

Referring now to FIG. 7, the packaging structure 10 is shown in the position after a fragile article 12 has been inserted for shipment. It will be evident that the platform portion 18 has become slightly lowered due to vertical loading, represented by the arrow 44, which also causes some peripheral compression as described above, and which is represented here as the arrows 60. In order to compensate for, and absorb this peripheral compression, and to prevent deformation of the corners 52, the indentation 54 closes slightly so that the end faces 56*a*, 56*b* are located closer together. An additional effect of the placement of the article 12 upon the packaging structure 10 is that the outboard wall 38 will bow outward slightly as shown at 38*a* and may even contact a wall of the container 14 (best seen in FIG. 1). Thus, the overall height of the packaging structure 10, 110 is reduced slightly.

Figure 8:
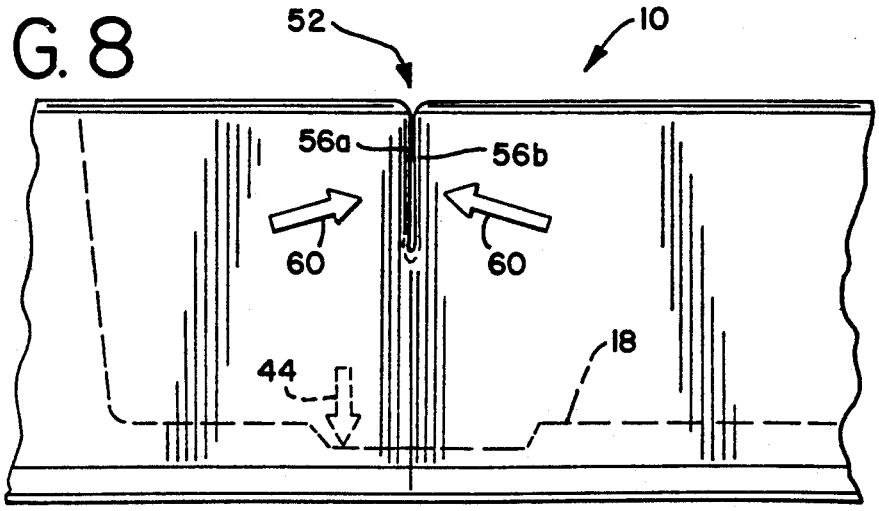
FIG. 8 illustrates a view taken along the line 8—8 of FIG. 4 and in the direction indicated generally when the packaging structure of the invention receives a shock or impact load.

Referring now to FIG. 8, the packaging structure 10 is shown in the maximum shock absorbing position, which will occur upon the application of a shock force to the container 14 and the transmission of that force to the fragile article 12. The impact, which is of the type occurring upon the dropping of the container 14, will cause sufficient g-forces to cause maximum vertical lowering of the platform portion 18 to virtually the full extent of the cushion distance 58. In this position, it is evident that the end faces 56*a*, 56*b* will assume a contacting relationship with each other through the application of the compression forces 60.

Also, the bowing out of the outboard wall 38 is more extreme in this situation, as indicated by the line 38*b* (best seen in FIG. 5). However, if the wall 38 had contacted a wall of the container 14 upon the insertion of the fragile article 12, the line 38*b* will represent the direction of forces generated by the shock impact, these forces being transmitted to the container 14. Furthermore, the overall height of the packaging structure 10, 110 will be reduced from the loaded condition depicted in FIG. 7.

Another important function of the shock limiting device 54 is to serve as a stop which limits the downward travel of the platform portion 18. FIG. 8 illustrates that as the platform portion 18 reaches the full limit of the cushion distance 58, the end faces 56*a*, 56*b* come into contact with each other. Through this closing of the end faces, the indentation 54 limits the compression forces 60 to reduce further vertical movement of the platform portion 18 towards the lower end 42 of the longer wall 38.

Referring to FIG. 2, it will be noted that a trough 62, or as illustrated a plurality of troughs 62 can be provided which are integrally formed into the platform portion 18 and which extend generally away from the bridge portion 26 of the sidewall structure 22. The trough or troughs 62 serve to provide structural support for the platform 18.

Figure 9:
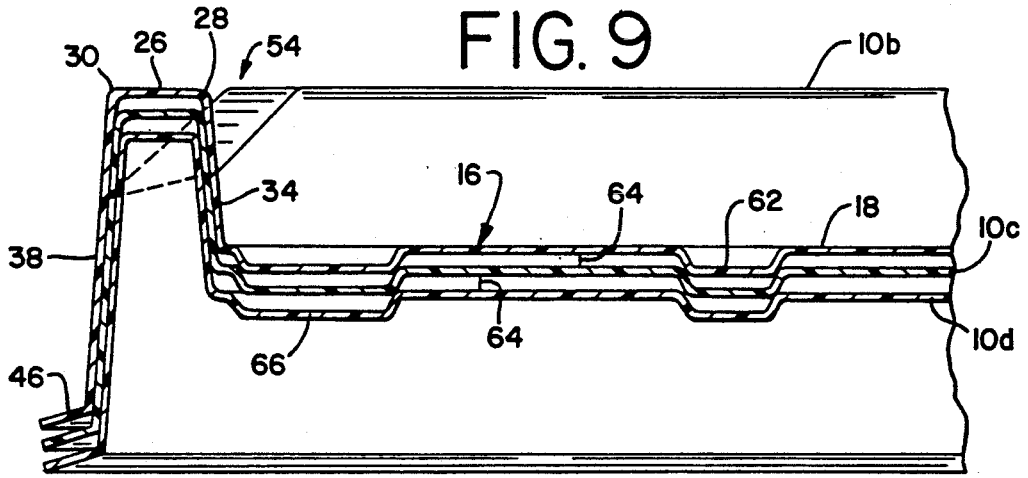
FIG. 9 is a fragmentary vertical sectional view of a plurality of packaging structures according to the invention shown in a nested arrangement.

Referring now to FIG. 9, an important feature of the packaging structure 10 of the present invention is that it can be made of a shape and size such that a plurality of the structures 10 can nest, one within the other. Three such structures, labeled 10*b*, 10*c*, 10*d*, are depicted. In particular, to facilitate nesting and the separation of nested package structures 10, 110, it is preferable that the shorter wall 34 and the longer wall 38 are drafted or slightly angled from the vertical away from each other and from the respective integral edges 28, 30 of the bridge section 26.

Thus, a plurality of the packaging structures 10 of the nature shown in FIG. 9 can nest, one within the other, and the total thickness of the resulting stack will simply be the total height of one of the packaging structures 10, plus the sum of thicknesses of the platform walls of additional packaging structures 10 which are nested with it, as well as a small vertical spacing distance 64 between platform 18 of adjacent pairs of structures 10. This stackability of the present packaging structure is a significant space-saving advantage over conventional foam packaging.

The platform portion 18 may, at times, advantageously include a formation for releasably engaging and limiting horizontal or lateral movement of the shock sensitive article 12. In the particular embodiment of the packaging structure 10 illustrated in FIG. 9, the first releasable engaging formation can be in the nature of one or more recesses 66, each of which is adapted to hold a protruding support 68, for example a foot, which protrudes from the shock sensitive article 12 (best seen in FIG. 1).

The embodiment of FIG. 3 shows another formation for releasably engaging and limiting horizontal or lateral movement of the shock sensitive article 12. In the case of FIG. 3, the second formation is in the nature of one or more recesses 70 formed in the shorter wall section 32. Note that the particular shock sensitive article 12 shown in FIG. 1 does not have protrusions which would fit in the recesses 70, but the invention is intended to cover instances when the shock sensitive article 12 does have protuberances which horizontally extend towards the shorter wall section 32.

It should be noted that it is not necessary that the platform portion 18 be generally planar as illustrated in the Figures. For example, in the packaging structure 10*a*, the platform portion 18 may be configured for a form-fitting relationship atop the shock sensitive article 12 as shown in FIG. 1. In such an instance, the platform portion 18 of the upper structure 10*a* would generally not be planar, but would instead be shaped to properly complement or match the top portion of the shock sensitive article 12 and fit telescopingly therewith.

Figure 10:
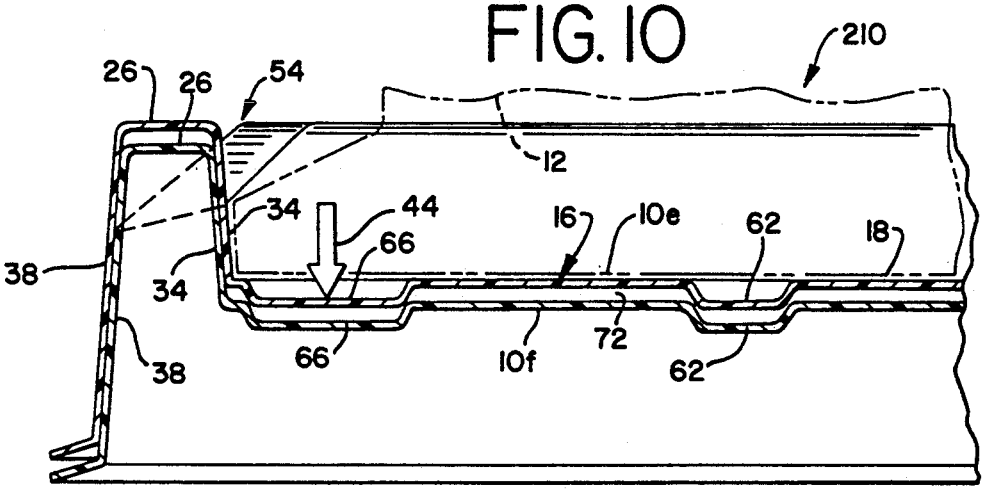
FIG. 10 is a fragmentary sectional view of an alternate embodiment of the invention.

Referring now to FIG. 10, another alternate embodiment of the packaging structure of the invention is generally designated 210. The embodiment 210 basically includes at least two structures 10, labeled 10*e* and 10*f*, which are placed one atop the other in nesting relationship for accommodating a single shock sensitive article 12 (shown partially in phantom). As such, identical components have been designated with identical reference numerals. This arrangement is contemplated for use in the case of unusually heavy fragile articles 12. Alternatively, the structures 10 may also be fabricated of relatively thin gage or otherwise less expensive polymeric material to save costs. Further, two or more such structures 10 may be used to provide the same amount of strength as a single structure 10 fabricated of relatively thicker or more costly material.

It has also been found that if the structures 10 are nested properly, an air pocket forms in the area 72 between the nested structures, which provides an additional shock absorbing cushion. Depending on the tightness of the nesting relationship, and the amount of air which is trapped in the area 72, even thinner gage, less costly materials may be employed than contemplated previously. If desired, the upper and lower packaging structures 10 may be fused together by chemical adhesive, ultrasonic welding or other methods, to seal the air space 72.

Referring now to FIG. 11*a*, another alternative embodiment of the packaging structure of the invention is generally designated 310. Components of the structure 310 which are identical to corresponding components of the structure 10 have been designated with identical reference numerals. The structure 310 differs from the structure 10 in that a web of material 74 is sealingly affixed to the lower end 42 of the wall 38, or to the foot 46. An air pocket 76 is thus created within the structure 310, which provides additional shock absorbing qualities. It will be appreciated however, that in this embodiment, any downward movement of the platform 18 into the cushion distance 58 is restricted by the air pocket 76. Further, the structure 310 would not be nestable, and would require greater storage space. However, the package 310 is contemplated for use with exceptionally heavy articles, and the above-identified disadvantages are outweighed by its greater shock absorbing capacity. As noted above, the structure shown in FIG. 11*a* also includes the alternative curved cross-sectional shape of the bridge **26*a* of the sidewall structure 22**.

FIG. 11*b* depicts another embodiment of the packaging structure 310, which is designated **310*a*, and is identical to the packaging structure 310 except for the fact that the bridge formation 26*b* is pointed or wedge-shaped in cross-section. This embodiment may be employed when greater flexibility of the sidewall structure 22 is desired. It will be appreciated that the bridge portion 26 may alternatively be rounded as in 26*a* or pointed as in 26*b***.

In operation, the package of the invention **10, 110, 210, 310, 310*a* is placed in the bottom 14*a* of the carton 14, and the fragile article 12 is positioned within the enclosure 24. This initial loading will cause the platform 18 to depress slightly, as depicted in FIG. 7. Upon this depression, the sidewall structure 22 will compress around the periphery of the article 12, thus gripping it tightly in the region of the inboard bridge edge 28. At the same time, the foot 46, and possibly a bowed portion of the longer wall 38 will press against the corresponding walls 14*b*, 14*c* of the container 14. In applications where the height of the fragile article 12 merits additional protection along the walls 14*b*, 14*c* of the container 14, additional structures 10, 10*a*, 110, 210, or 310 may be placed around the sides of the article 12 between the article and the container wall. Such additional structures may be separate units as shown in FIG. 1, or may be joined along adjacent edges 50 of the foot 46**.

Should the carton 14 be dropped or suffer some shock impact which exerts a force on the packaged article 12, the platform portion 18 will move downward, into the cushion distance 58, causing a longitudinal compression about the enclosure 24. The downward movement of the platform portion 18, and the compression of the sidewall structure 22, will be stopped once the adjacent faces **56*a*, 56*b* of the shock limiting indentations 54 come into contacting relationship with each other. This downward movement will preferably be within the maximum cushion distance 58. Once the shock impact has passed, the package 10, 110, 210, 310, 310*a*** will resume its original loaded position, and will be capable of absorbing repeated shock impacts without suffering a deterioration of shock absorbing capacity.

INDUSTRIAL APPLICABILITY

The present invention provides a unitary packaging structure **10, 110, 210, 310, 310*a* which is useful for providing cushioning for a shock sensitive article 12. Advantages of the packaging structure 10, 110, 210, 310, 310*a* of the present invention include that it can absorb repeated shocks of as much as 90% of its cushioning distance, that it can be made of material which is substantially 100% recyclable, it can be made inexpensively by mass production techniques, and a plurality of the packaging structures 10, 110** can be readily stacked together in a small space for storage and/or shipment. A significant environmental advantage is provided utilizing such structures as opposed to the prior art rigid polystyrene foams.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A unitary packaging structure for a shock sensitive article, comprising:

a platform portion having sufficient rigidity to support the article and having a peripheral portion; and a sidewall structure of flexible material forming an enclosure around said platform portion, said sidewall structure including an inboard wall being integral with said peripheral portion, and an outboard wall maintained in spaced relationship from said inboard wall by a bridge section, said inboard wall being relatively shorter than said outboard wall so that said platform portion is held a specified cushion distance above a lower edge of said outboard wall;

shock limiting means formed in said sidewall structure for restricting the movement of said platform portion toward said lower edge of said outboard wall upon generally vertical shock loading of said platform portion, said means including formations in said bridge section and said inboard and outboard walls which define said sidewall structure into multiple wall segments, said segments being configured so that upon generally vertical shock loading of said platform portion, the contacting of adjacent wall segments of said multiple wall segments at at least one of said formations limits movement of said platform portion and the article.

2. A packaging structure as defined in claim 1 wherein each said shock limiting formation includes at least one indentation in said bridge section and said inboard and outboard walls, said indentation defining said sidewall structure into said multiple wall segments, said wall segments having end faces, and upon said generally vertical shock loading of said platform portion, said end faces of adjacent wall segments being configured to contact each other to limit the movement of said platform portion.

3. A packaging structure as defined in claim 2 wherein each said indentation is generally V-shaped and extends from said bridge section into said inboard wall and said outboard wall.

4. A packaging structure as defined in claim 2 wherein said shock limiting means limits the movement of said platform portion to a distance which is less than or equal to said cushion distance.

5. A packaging structure as defined in claim 4 wherein said shock limiting means limits the movement of said platform portion to a distance which is 90% of said cushion distance.

6. A packaging structure as defined in claim 1 further including a container having a plurality of walls and a bottom upon which said packaging structure is positioned, said outboard wall being configured to contact at least one of said walls of said container.

7. A packaging structure as defined in claim 1 wherein said platform portion and said sidewall structure are formed from a single sheet of polymeric material.

8. A packaging structure as defined in claim 1 wherein said shock limiting means is designed to absorb repeated shock loading to the shock sensitive article.

9. A packaging structure as defined in claim 1 wherein said inboard wall and said outboard wall are drafted relative to said bridge section for facilitating nesting of multiple package structures.

10. A packaging structure as defined in claim 1 wherein said sidewall structure is configured to accommodate an amount of lateral compression which is approximately equal to said cushion distance.

11. A unitary packaging structure as defined in claim 1 wherein said bridge section is rounded in cross-section.

12. A unitary packaging structure as defined in claim 1 wherein said bridge section is pointed in cross-section.

13. A unitary packaging structure as defined in claim 1 further including a web of material secured to a lower edge of said sidewall structure to define an air pocket.

14. A unitary packaging structure as defined in claim 13 wherein said web of material is sealingly secured to said lower edge of said longer wall.

15. A packaging structure for a shock sensitive article, comprising:

at least one packaging structure unit disposed in tight, nesting relationship to another such packaging structure, each such structure unit including:

a platform portion having sufficient rigidity to support the article and having a peripheral portion; and a sidewall structure of flexible material forming an enclosure around said platform portion, said sidewall structure including an inboard wall being integral with said peripheral portion, and an outboard wall maintained in spaced relationship from said inboard wall by a bridge section, said inboard wall being relatively shorter than said outboard wall so that said platform portion is held a specified cushion distance above a lower edge of said outboard wall;

shock limiting means formed in said sidewall structure for restricting the movement of said platform portion toward said lower edge of said outboard wall upon generally vertical shock loading of said platform portion, said means including integral formations in said bridge section and said inboard and outboard walls which define said sidewall structure into multiple wall segments, said segments being configured so that upon generally vertical shock loading of said platform portion, the contacting of adjacent wall segments of said multiple wall segments at at least one of said formations limits movement of said platform portion and the article.

16. A packaging structure as defined in claim 15 wherein each said at least one packaging structure unit is fixed to an adjacent nested unit to form an air space therebetween.

17. A unitary packaging structure for use in packaging a shock sensitive article in a container, comprising:

a platform portion having a peripheral portion and having sufficient rigidity to support said article; and a sidewall structure which forms an enclosure, the sidewall structure having a bridge section which has inboard and outboard end portions, a relatively shorter wall having a proximal end integral with the inboard end portion of the bridge section and a distal end extending in a direction away from the bridge section and a relatively longer wall having a proximal end integral with the outboard end portion of the bridge section and a distal end extending in said direction away from the bridge section, the peripheral portion of the platform being integral with the distal end portion of the shorter wall such that the platform portion of the platform is supported by the sidewall structure; and shock limiting means formed in said sidewall structure for restricting the movement of said platform portion toward said lower edge of said outboard wall upon generally vertical shock loading of said platform portion, said means including integral formations in said bridge section and said inboard and outboard walls which define said sidewall structure into multiple wall segments, said segments being configured so that upon generally vertical shock loading of said platform portion, the contacting of adjacent wall segments of said multiple wall segments at at least one of said formations limits movement of said platform portion and the article.

18. A packaging structure as set forth in claim 17, wherein said sidewall structure further includes a foot structure having inboard and outboard peripheral portions, the foot structure extending along the distal end portion of the longer wall, the inboard peripheral portion of the foot structure being integral with the distal end portion of the longer wall, the outboard peripheral portion of the foot structure extending outboard from the distal end portion of the longer wall.

19. A packaging structure as set forth in claim 17, wherein said packaging structure, when viewed from each of an upper and lower perspective, is generally in the form of a polygon having a plurality of corners and wherein there are at least two indentations formed in said bridge section, said inboard wall and said outboard wall, each said indentation disposed at a different corner of the polygon.

20. A packaging structure as set forth in claim 17, wherein the shock sensitive article includes at least one protruding support, and further including formations on said packaging structure for releasably engaging the at least one protruding support.

21. A packaging structure as set forth in claim 17, further including rib means for strengthening said platform.

22. A unitary packaging structure for a shock sensitive article, comprising:

a platform portion being provided with sufficient rigidity to support the article and having a peripheral portion; and a sidewall structure of flexible material forming an enclosure around said platform portion, said sidewall structure including an inboard wall being integral with said peripheral portion, and an outboard wall maintained in spaced relationship from said inboard wall by a bridge section, said inboard wall being relatively shorter than said outboard wall so that said platform portion is held a specified cushion distance above a lower edge of said outboard wall;

shock limiting means formed in said sidewall structure for restricting the movement of said platform portion toward said lower edge of said outboard wall upon shock loading of said platform portion, said shock limiting means including at least one indentation in said bridge section and said inboard and outboard walls, said indentation defining said sidewall structure into multiple wall segments having end faces, and upon shock loading of said platform portion, said end faces of adjacent wall segments being configured to contact each other to limit the movement of said platform portion.

* * * * *